US007037211B1

(12) United States Patent
Kosovac

(10) Patent No.: US 7,037,211 B1
(45) Date of Patent: May 2, 2006

(54) GOLF CLUB

(75) Inventor: Milana Kosovac, New York, NY (US)

(73) Assignee: Chapel Golf, Inc., North Palm Beach, FL (US)

( * ) Notice: Subject to any disclaimer, the term of this patent is extended or adjusted under 35 U.S.C. 154(b) by 603 days.

(21) Appl. No.: 09/618,076

(22) Filed: Jul. 17, 2000

Related U.S. Application Data

(60) Provisional application No. 60/148,011, filed on Aug. 10, 1999.

(51) Int. Cl.
*A63B 53/02* (2006.01)

(52) U.S. Cl. ..... 473/304; 473/312; 473/341; 473/342

(58) Field of Classification Search ..... 473/342, 473/340–341, 312, 313, 314, 304
See application file for complete search history.

(56) References Cited

U.S. PATENT DOCUMENTS

| | | | | |
|---|---|---|---|---|
| 1,319,802 | A | | 10/1919 | Shea |
| 3,042,405 | A | | 7/1962 | Solheim |
| 3,220,733 | A | | 11/1965 | Saleeby |
| 3,387,844 | A | | 6/1968 | Shippee |
| 3,516,674 | A | | 6/1970 | Scarborough |
| 3,873,090 | A | * | 3/1975 | Thompson ..... 473/312 |
| 4,113,249 | A | | 9/1978 | Beery |
| 4,162,074 | A | | 7/1979 | Thomson |
| 4,444,395 | A | | 4/1984 | Reiss |
| 4,912,830 | A | | 4/1990 | Vesligaj |
| 4,915,385 | A | | 4/1990 | Anderson |
| 4,979,744 | A | * | 12/1990 | Alcala |
| 5,090,698 | A | | 2/1992 | Kleinfelter |
| 5,127,653 | A | | 7/1992 | Nelson |
| 5,137,275 | A | * | 8/1992 | Nelson |
| 5,277,866 | A | | 1/1994 | Wright |
| 5,308,067 | A | | 5/1994 | Cook |
| 5,308,068 | A | * | 5/1994 | Strand ..... 473/251 |
| 5,342,812 | A | * | 8/1994 | Niskanen et al. ..... 501/127 |
| 5,382,019 | A | | 1/1995 | Sneed |
| 5,388,827 | A | * | 2/1995 | Reynolds |
| 5,501,461 | A | | 3/1996 | Donofrio |
| 5,536,011 | A | | 7/1996 | Gutowski |
| 5,558,332 | A | | 9/1996 | Cook |

(Continued)

FOREIGN PATENT DOCUMENTS

| | | | |
|---|---|---|---|
| EP | 0 965 366 | A1 | 12/1999 |
| FR | 2523854 | A | 9/1983 |
| GB | 2309390 | A | 7/1997 |
| GB | 2336123 | A | 10/1999 |
| TW | 362523 | A | 6/1999 |
| WO | WO 99/24124 | A | 5/1999 |
| WO | WO 01/10513 | A | 2/2001 |

OTHER PUBLICATIONS

Patent Abstracts of Japan, vol. 018. No. 451, regarding Japanese Patent Publication JP–A–6–142240 (Kurien K.K.) (Aug. 23, 1994).

*Primary Examiner*—Stephen Blau
(74) *Attorney, Agent, or Firm*—Leydig, Voit & Mayer, Ltd

(57) ABSTRACT

A golf club having superior balance and sensory feedback which includes a shaft connected to a clubhead comprising two basic elements, an integrated hosel and insert which defines a striking surface and a shell including a distal toe portion, and a heel portion uniquely integrated with the combined hosel and insert. In preferred embodiments the clubhead has a cylindrical striking surface, polar mass concentrations for optimum dynamic performance and a medial shell portion coupling the toe and heel portions to the insert. A cavity behind the striking surface of the insert enhances the sound of impact and a visible top surface of the insert integral with the hosel with sighting indicia enhances golfer alignment and stroking of the ball to provide resultant confidence and consistency.

22 Claims, 12 Drawing Sheets

U.S. PATENT DOCUMENTS 5,797,176 A * 8/1998 Rose
5,842,935 A 12/1998 Nelson
5,938,543 A 8/1999 McGeeney et al.
6,083,115 A * 7/2000 King
6,095,931 A 8/2000 Hettinger et al.
6,328,662 B1 12/2001 Huang

* cited by examiner

Fig. 5a
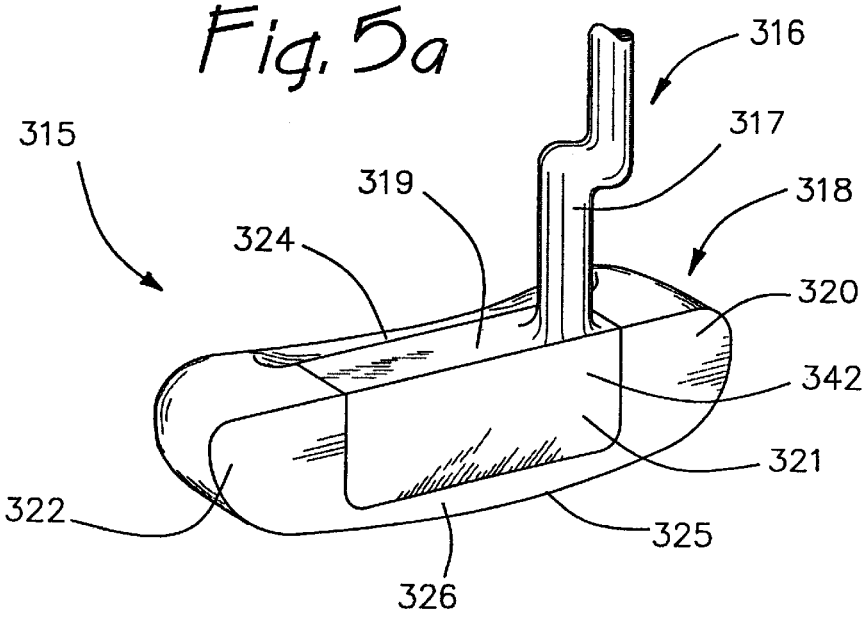
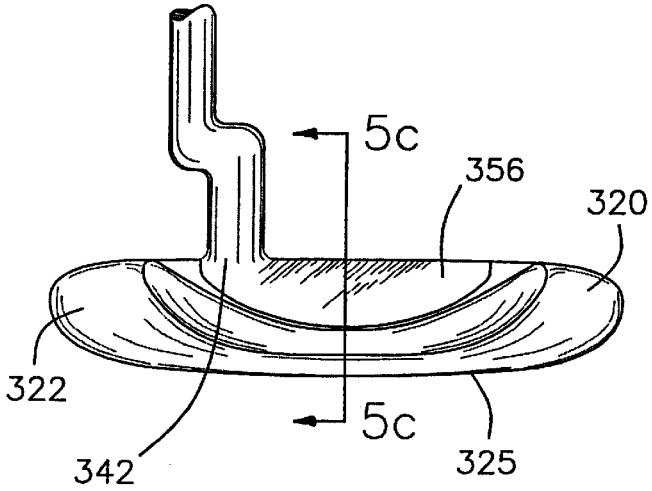
Fig. 5b
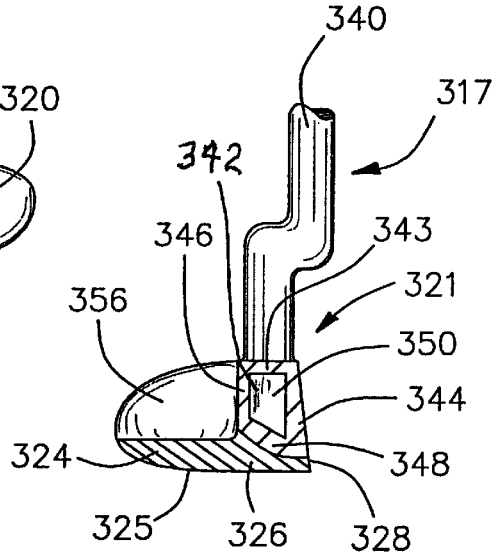
Fig. 5c

GOLF CLUB

REFERENCE TO RELATED PATENT APPLICATION

This patent application claims the benefit of U.S. Provisional Patent Application No. 60/148,011 filed Aug. 10, 1999.

TECHNICAL FIELD OF THE INVENTION

The present invention relates to the field of golf clubs, and more particularly, to the field of golf putters.

BACKGROUND OF THE INVENTION

The prior art has provided numerous golf clubs, and particularly, golf putters, that are designed to improve the performance of the golfer or otherwise enhance the golfing experience. For example, U.S. Pat. No. 3,042,405 to Karsten Solheim discloses a golf club having internal weights at the heel and toe ends of the club with two thin plates connecting them. The sound of the club as it strikes a golf ball at the center of the club face is described as different from the sound made by the golf club when striking the golf ball at an off-center position. It is stated that the substantially hollow center behind the front face of the club provides an audible indication when the golfer has struck the golf ball at the optimum central portion of the club. U.S. Pat. No. 4,444,395 to Morton Reiss shows a golf putter head having a low mass center section and two more massive end sections. The sections have substantially the same transverse cross section forming a single continuous cylinder. A major portion of the mass is in the end portions which are connected together longitudinally to the center section by two steel pins. The club shaft is secured to the head centrally in the center section. More recently, U.S. Pat. No. 5,090,698, issued to Thomas A. Kleinfelter, and discloses a golf putter having a clubhead with a striking face suspended between two flanges near the toe and heel. This is said to provide a center of percussion extending along essentially the entire length of the clubhead to thereby provide an optimum strike against the ball even if the ball contact is off center. Numerous other golf clubs have been provided in the prior art described by the designers as enhancements of sound, balance, or human factor considerations.

Some golf clubs known in the art are said to have a substantially awkward "feel" when striking a golf ball, believed to be in part because of the distribution of weight within the clubhead. In addition, while the prior art has provided other golf clubs that are said to have a proper feel and to be properly balanced, many of these golf clubs are unattractive and the physical appearance is distractive. Those configurations do not provide the optimum perspective to the golfer as the ball is addressed or audible response as the club strikes the ball. There thus exists a need in the art for a golf club that has an optimum feel and sound, an appearance which supports concentration and a sighting perspective and audible response that optimize the relationship between golfer and putter. It is a general object of the invention to provide a club that satisfies the foregoing criteria.

Specifically, the general objects of the invention include the creation of a golf club, especially a putter, that provides sensitive feed-back to the golfer for improved performance. The golfer, golf club and golf ball are connected during the swing and at impact to provide superior sensitivity to the action, a dynamic sense of balance and an enhanced "feel" which is fed back to the hands indicative of stroke quality. This is augmented by the enhanced visual perception or "sighting" provided. The improved characteristics are believed to result from the integrated nature of the hosel and an insert which includes the striking surface, augmented by the other features of the invention described and claimed.

SUMMARY OF THE INVENTION

The present invention provides a well-balanced golf club that satisfies the foregoing general objects. The golf club of the invention includes a shaft that has a handle end and a clubhead end. The clubhead end is connected to a clubhead comprising two basic elements. The two basic clubhead elements are (1) a combined hosel and insert defining a striking surface integrally related to a sighting surface and to the shaft and handle, and (2) a shell including a distal toe portion and a heel portion, each secured to the insert. Where the shaft and the insert are of the same material they may be formed as a single unit. In a preferred embodiment, a medial portion is secured between the heel and toe portions configured for optimum dynamic balance, sensitive feed-back and related enhanced sighting. The combined insert and hosel are preferably of low mass density materials compared to the shell to provide an optimum polar mass distribution. The insert is visible on a top surface which will assist the golfer in addressing the ball and aligning the club and ball for the putt. Top surface treatment in a preferred embodiment can further enhance the sighting.

In preferred embodiments of the invention, the clubhead insert has a striking surface having a cylindrical configuration and preferably a cylindrical configuration the longitudinal axis of which is aligned with the longitudinal axis of the clubhead. In some preferred embodiments, a space is provided behind the striking surface to provide an audible response indicative to the golfer of stroke quality.

Also, in preferred embodiments of the invention, high mass density elements are added to the toe portion and the heel portion of the shell to improve the optimum balance and dynamic characteristics of the putter. In various preferred embodiments of the invention, the insert can have a front plate defining the striking surface integral with the hosel and secured to the toe, heel and medial portions of the shell or it may have various configurations including a longitudinal channel shape or comprise a longitudinal cylindrical tube extending from a base or root in the heel. In still other preferred embodiments, the combined hosel and insert includes a reinforcing armature connecting the hosel and insert and the insert is a generally rectilinear blade having an exposed striking surface, sole surface and sighting top surface. Furthermore, the hosel includes an offset portion to generally align the shaft axis with the striking surface.

Other features and objects of the invention will be apparent from the following description of the invention.

DESCRIPTION OF THE DRAWINGS

FIGS. 5*a*–5*c* are, respectively, a perspective view, a rear view and a sectional view of still another clubhead embodying the invention;

DESCRIPTION OF THE INVENTION

Figure 1:
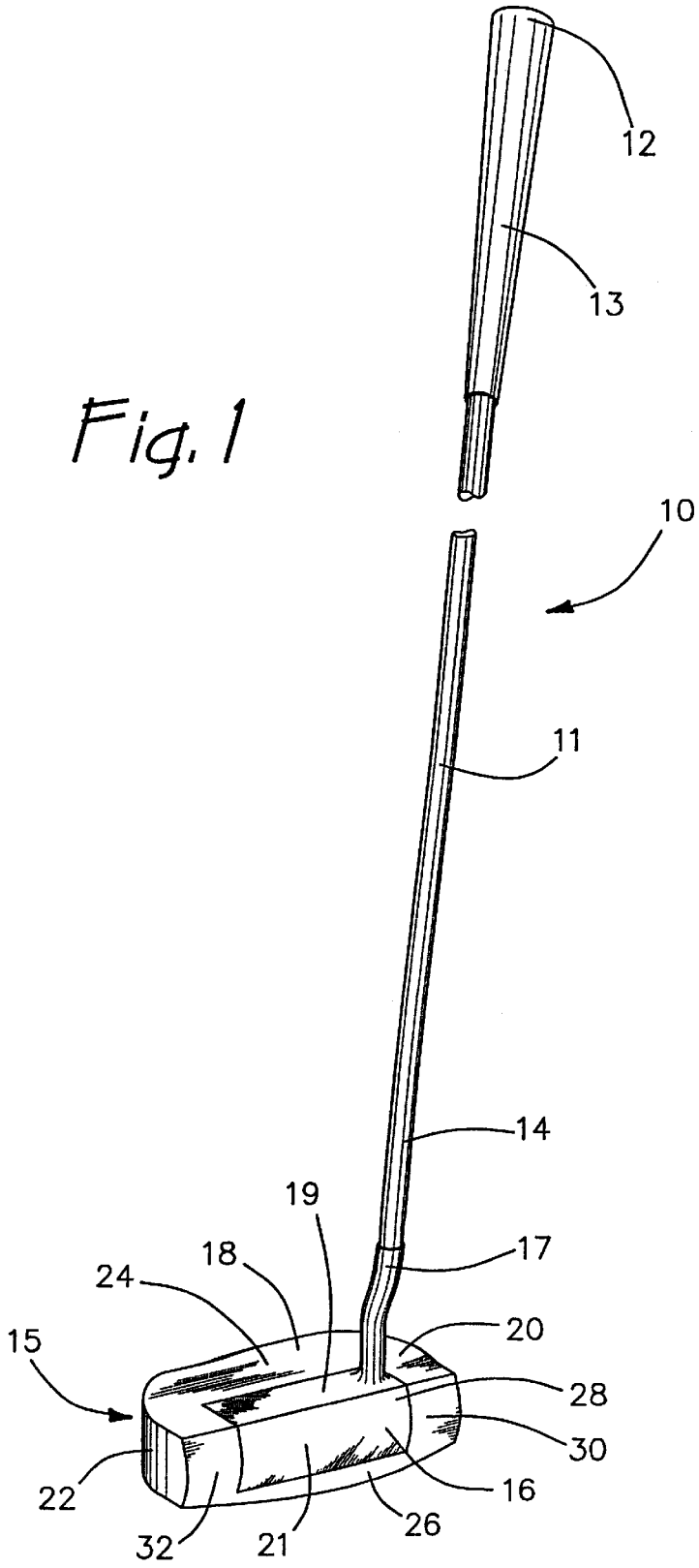
FIG. 1 is an overview perspective of one embodiment of the invention.

The invention provides a golf club which may constitute any one of a set of golf clubs designed for the game of golf including, for example, a driver, a fairway "wood" or "iron" or other club. Preferably, however, the golf club of the invention is in the form of a putter and is thus designed to facilitate controlled golfer action in striking a golf ball on a relatively smooth playing surface to cause the golf ball to roll toward its intended target and not to impart loft to the ball. With reference to FIG. 1, the golf club 10 has a clubshaft 11 which may be fabricated from graphite, metal or other conventional materials. At the golfer gripping end 12 of shaft 11, an overlying grip 13 is provided which may be leather, and may have any conventional surface treatment. Opposite the gripping end 12, the shaft 11 has a clubhead end 14 which is mounted to a clubhead 15.

The clubhead 15 comprises two basic components, a combined insert and hosel 16 and a shell 18. The shell 18 includes a heel portion 20, a toe portion 22, and a medial portion 24. In the embodiments of FIG. 1, the shell also includes a sole portion 26. The hosel includes a central portion that provides an offset whereby the shaft is aligned with the striking surface.

In the embodiment shown in FIG. 1, the insert 21 has a cylindrical-type striking surface 28 which conforms to similar cylindrical-type striking surfaces 30 and 32 on the shell 18. The striking surfaces 28, 30 and 32 align to define a clubhead striking face. In the preferred embodiment, the striking face comprises a segment of a right circular cylinder, the directrix of which aligns with the longitudinal axis of the clubhead. In one preferred embodiment, that directrix is slightly above the longitudinal central axis of the clubhead. Thereby, when the clubhead strikes a golf ball with an optimum stroke, it imparts a slight negative loft to the ball.

Figure 2A:
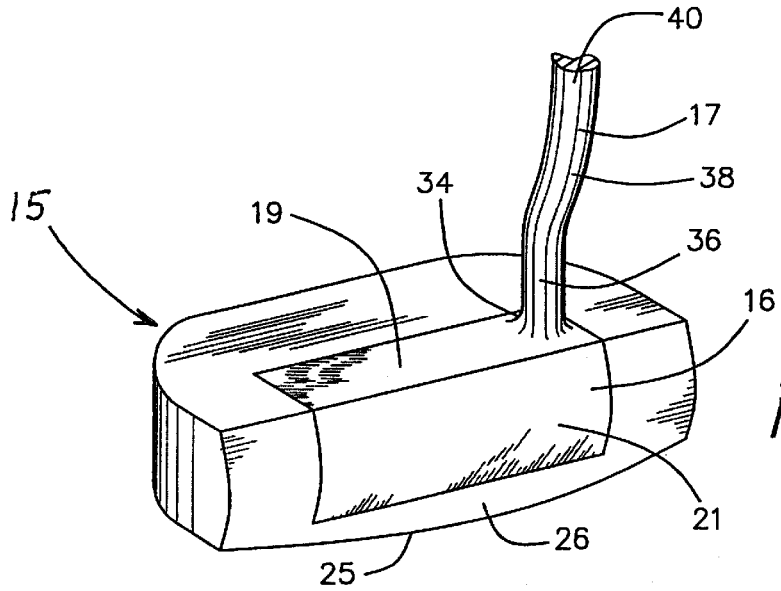
FIG. 2*a* is a perspective view of the clubhead of the embodiment of the invention shown in FIG. 1.
Figure 2B:
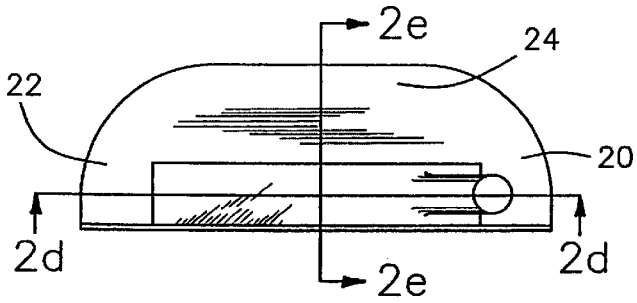
FIG. 2*b* is a top view of the embodiment of FIG. 2*a;*
Figure 2C:
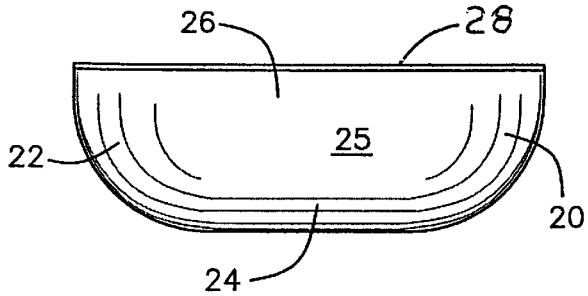
FIG. 2*c* is a bottom view of the embodiment of FIG. 2*a*.
Figure 2D:
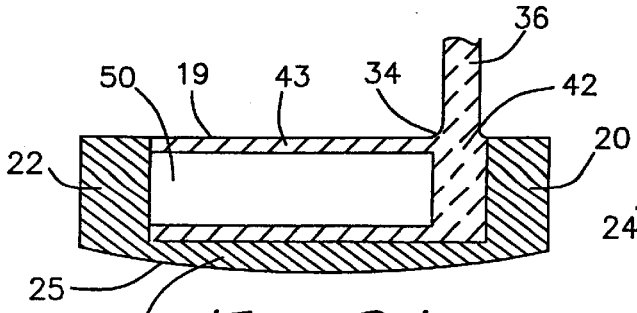
FIGS. 2*d* and 2*e* are sectional views taken along the lines 2*d* and 2*e* of FIG. 2*b;*
Figure 2E:
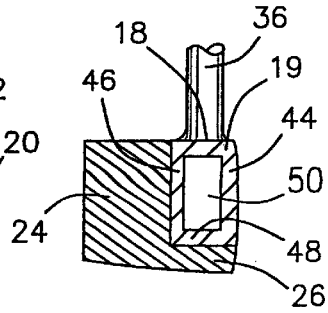
Figure 3A:
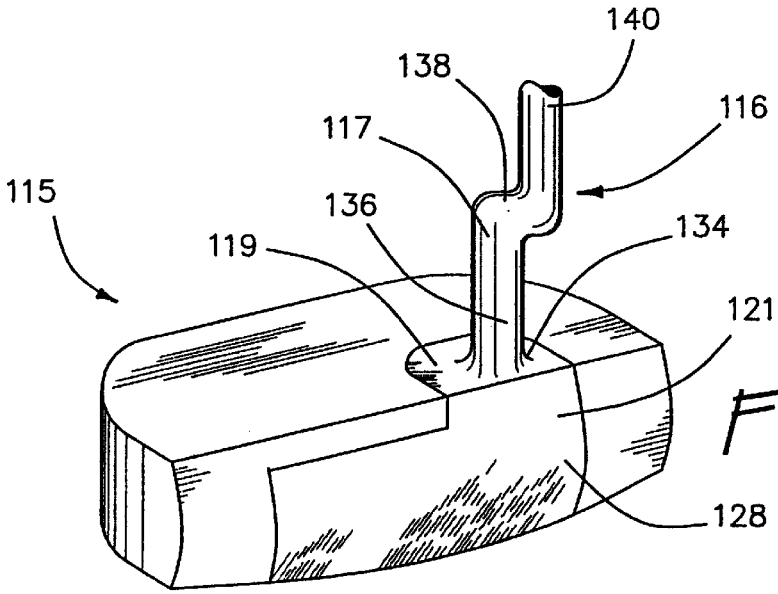
FIGS. 3*a*–3*e* are, respectively, a perspective view, a top view, a bottom view and sectional views of another embodiment of the invention.
Figure 3B:
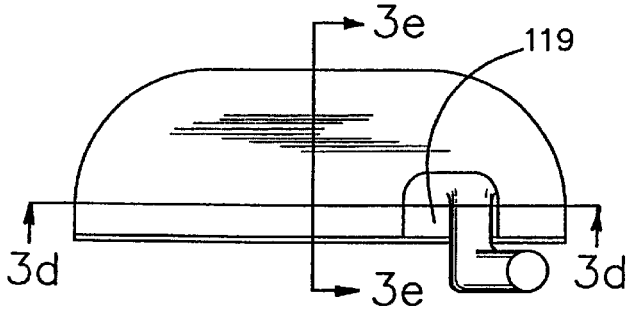
Figure 3C:
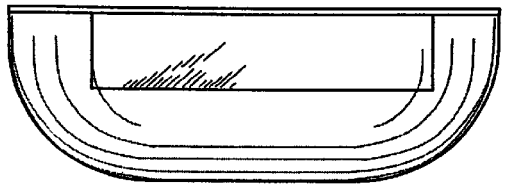
Figure 3D:
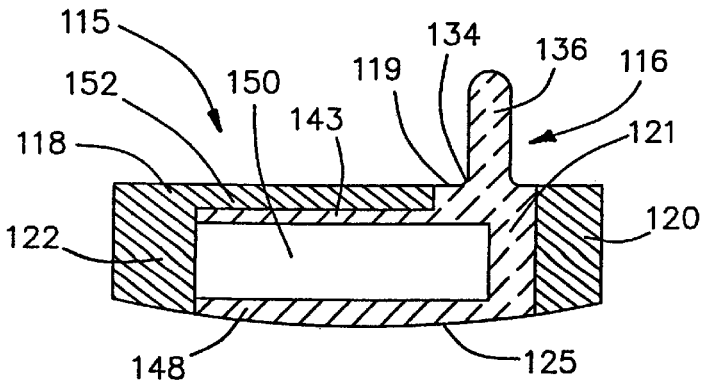
Figure 3E:
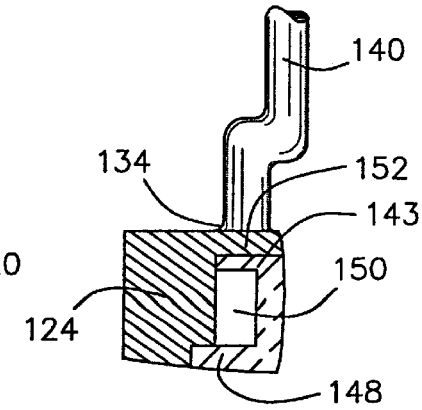

Referring now to the more detailed Figures of the drawings, FIGS. 2*a*–2*e* illustrate in greater detail the embodiment of FIG. 1. The shaft 11 and grip 13 of FIG. 1 are omitted in FIGS. 2*a*–*e*, the shaft portion 40 of the hosel 17 have been partially broken away and a fairing 34 is disposed between the upright portion 36 of the hosel 17 and the top sighting surface 19 of insert 21. As shown in FIG. 2*a*, the hosel portion 17 of the combined insert and hosel 16 may include the upright portion 36, an angular portion 38, and the shaft portion 40. In the preferred embodiment, the central axes of the angular portion 38 of hosel 17 forms a small acute angle with the striking surface and with the shaft. The offset aligns the shaft with the striking surface. In the embodiment of FIG. 2, the bottoms of heel portion 20, toe portion 22, sole portion 26 and medial portion 24 comprise the sole or sole plate 25 of the club as shown in FIG. 2*c*. Also, in the embodiment of FIG. 2 and in other preferred embodiments, the sole 25, whether made up entirely of portions of shell 18 or not has a curvature along the longitudinal axis of the clubhead 15 with the central portion of the striking surface 28 of insert 21 being disposed at the optimum striking point or "sweet spot" both longitudinally and vertically.

In the embodiment of FIGS. 2*a*–*e*, the combined insert and hosel 16 includes a base portion 42 underlying the hosel 17 and the insert extends longitudinally along the clubhead therefrom in the form of a rectangular tube including a top wall 43 defining the sighting surface 19, a striking side wall 44, a vertical back wall 46 spaced from striking wall 44 and a bottom wall 48 parallel to and spaced from the top wall 19 to define a cavity 50. It has been found that providing the cavity 50 enhances the sound upon impact of the clubhead with the ball producing a positive clicking sound. That sound varies with the point of impact of the ball and club both vertically and along the longitudinal axis of the clubhead. The combined insert and hosel 16 is preferably formed of a non-metallic and usually a composite material such as a graphite composite or a fiberglass and resin composite. It is desirable that the mass density of the combined insert and hosel 16 be less than the mass density of the shell to provide polar weighting of the clubhead and resulting enhanced dynamic performance of the club.

Referring now to FIGS. 3*a*–*e*, another preferred clubhead embodiment 115 of the invention is shown in which the combined hosel and insert 116 differs in several significant respects from the corresponding part 16 of FIG. 2. The hosel 117 is of a known type with sharp, transverse offset 138 designed to displace the shaft end 140 toward alignment with the striking surface 128. The clubhead portion 136 of the hosel 117 is integral with the insert 121 and extends from the top wall 143 of insert 121.

It has been found that the visibility of at least a significant portion of the top insert surface 119 and fairing 134 provides the golfer with a feeling of an integrated grip and striking surface through the connection of the clubhead portion 136 of the hosel 117 with the top sighting surface 119 through the fairing 134. In addition to the heel portion 120 and toe portion 122 of the shell 118, the shell has a top portion 152 forming a part of medial portion 124 extending toward the striking surface 128. In the embodiment of FIGS. 3*a*–*e*, the bottom wall 148 of insert 121 forms part of sole plate 125 and the medial shell portion 124 defines the backwall for cavity 150.

Figure 4A:
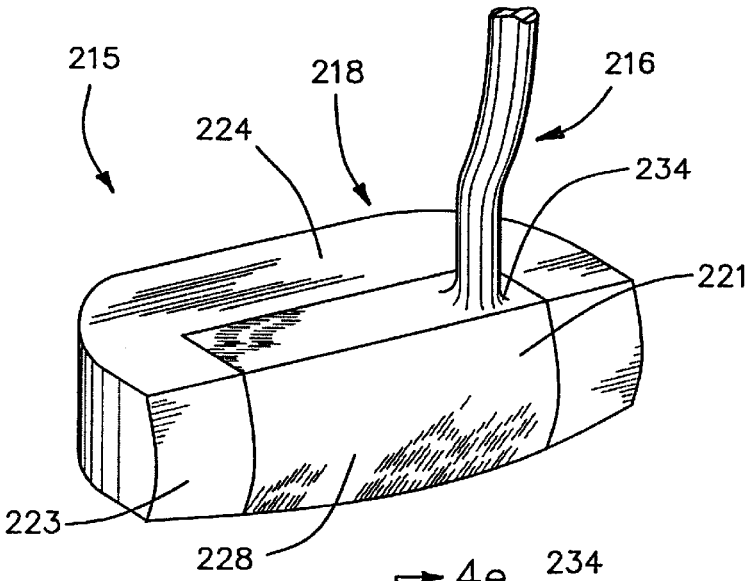
FIGS. 4*a*–4*e* are, respectively, a perspective view, a top view, a bottom view, and sectional views of the clubhead of an additional embodiment of the invention.
Figure 4B:
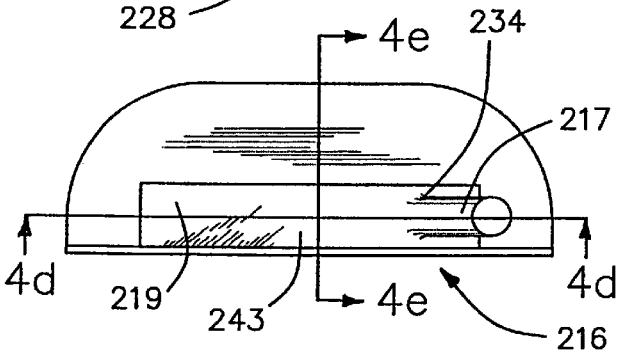
Figure 4C:
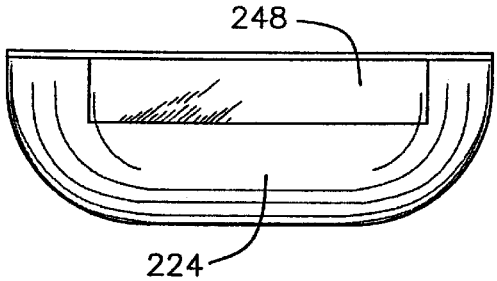
Figure 4D:
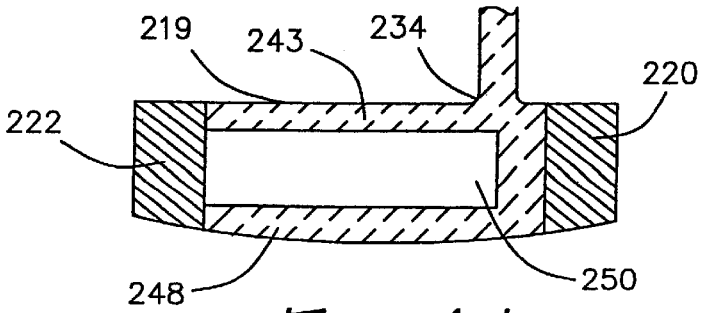
Figure 4E:
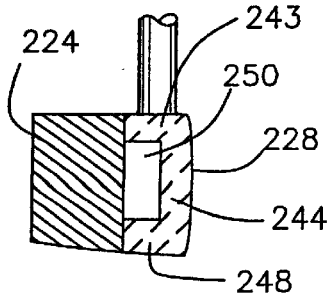

Referring now to FIGS. 4*a*–*e*, the clubhead 215 comprises the combined insert and hosel 216 and the shell 218. In the embodiment of FIG. 4 the insert 221 extends the full height of the striking face 223 and has a cylindrical striking surface 228 parallel to the longitudinal axis of the club as already described above with respect to FIGS. 2*a*–2*e*. As shown in FIGS. 4*a* and 4*e*, especially, the curved surface is a segment of a right circular cylinder with the directrix rearwardly thereof and slightly above the center of the clubhead to impart a slight negative loft upon impact with the ball. In this embodiment as shown in FIG. 4*b*, the top surface 219 of the insert 221 is fully visible and the fairing 234 connecting the insert 221 and the hosel 217 is directly viewable by the golfer as he addresses the ball. As the striking or forward surface 228 extends the full height of the clubhead, the bottom wall 248 of insert 219 comprises the sole of the club. The top wall 243 combines with the bottom wall 248 and striking wall 244 to define the cavity 250 in cooperation with the medial portion 224 of the shell 218.

Another preferred embodiment is shown in FIGS. 5*a*–*c*. In this embodiment the combined insert and hosel 316 includes a hosel 317 of the offset type as already described with respect to FIGS. 3*a*–3*e*, and the insert 321 is of the tubular type already described with respect to FIGS. 2*a*–2*e*. The shell 318 has a medial portion 324 below the insert to define a back shelf and cavity. The shell also has a heel portion 320 and a toe portion 322 similar to those portions of the embodiment of FIGS. 2*a*–*e*. The embodiment of FIGS. 5*a*–*c* is of the well known and often preferred cavity back type wherein the medial portion 324 and a sole wall 326 of the shell 318 are integral to form the sole 325 of the club while there is a back cavity 356 above the medial portion 324 of shell 318. In this preferred embodiment, the insert has longitudinally extending top wall 343, bottom wall 348, striking wall 344 and back wall 346 which define a longitudinal insert cavity 350 extending from the base 342. The top wall 343 provides the top surface 319 for optimum golfer viewing and alignment of the integral hosel and insert with the club grip and the ball. The striking wall 344 is canted slightly to define a striking surface 328 that provides a slight loft.

Figure 6A:
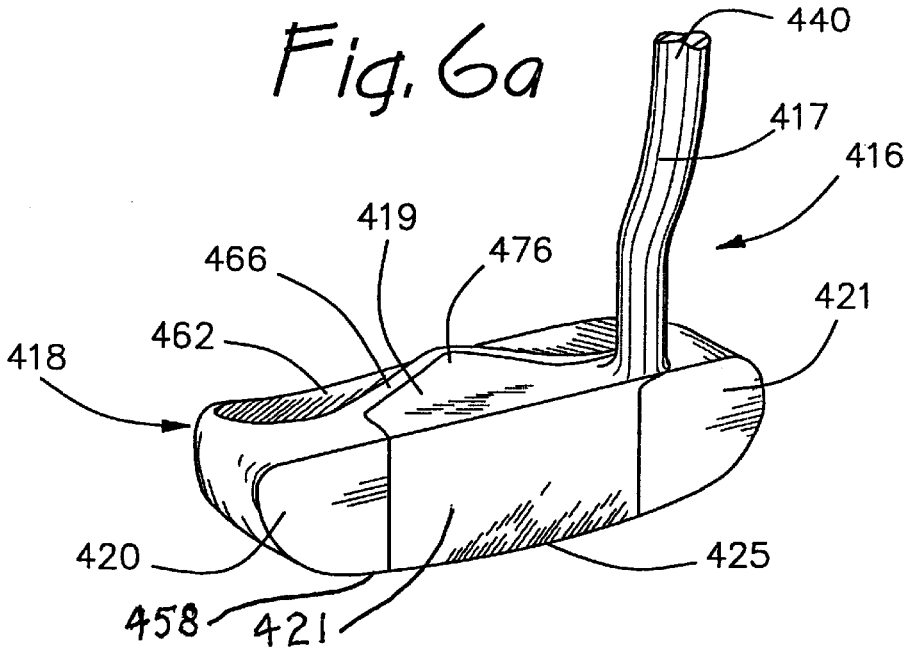
FIGS. 6*a*–6*c* are, respectively, a perspective view, a rear view and a sectional view of a clubhead forming a part of another embodiment of the invention.
Figure 6B:
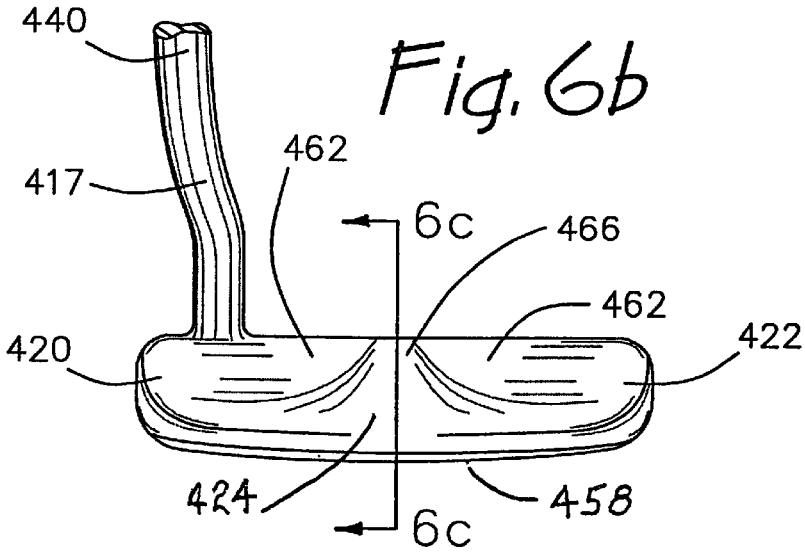
Figure 6C:
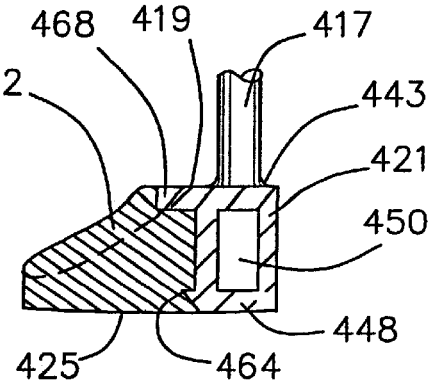

The embodiments of FIGS. 6*a*–6*c* is preferred by some golfers because of the enhanced shape of the upper surfaces to provide optimum alignment. As shown in FIGS. 6*a*–*c*, the hosel 416 is of the double-curved type as explained in some detail with respect to FIGS. 1 and 2*a*–*e*. The insert 421 is of the box-type, very similar to that shown and described with respect to FIGS. 2*a*–*e*. In the insert 421, the cavity 450 is defined by a bottom wall 448 which also comprises the forward portion of the sole 425. The shell 418 has a sole surface 458 defined by toe portion 422, heel portion 420 and medial portion 424. Sole surface 458 aligns with the sole portion of bottom wall 448 of insert 421 to define sole 425.

In this embodiment the top wall 443 of the insert 421 extends rearwardly in the sweet spot area to enhance alignment. The top wall 443 is chevron shaped with the central point spaced longitudinally from the hosel 417 to define an alignment portion 476 of the top sighting surface 419 in the nature of a chevron. This surface 419 may include surface treatment such as embossed lines, arrows or the like to further augment alignment accuracy. The shell 418 has a chevron portion 466 rearwardly of the insert 421 and shaped to conform to the chevron of insert 419 to provide enhanced structural integrity and an aesthetic configuration for the back cavity 462. The transverse projection 464 extends rearwardly from the insert 421 and is interfitted into the corresponding portions of the shell 418 for enhanced structural integrity.

Figure 7A:
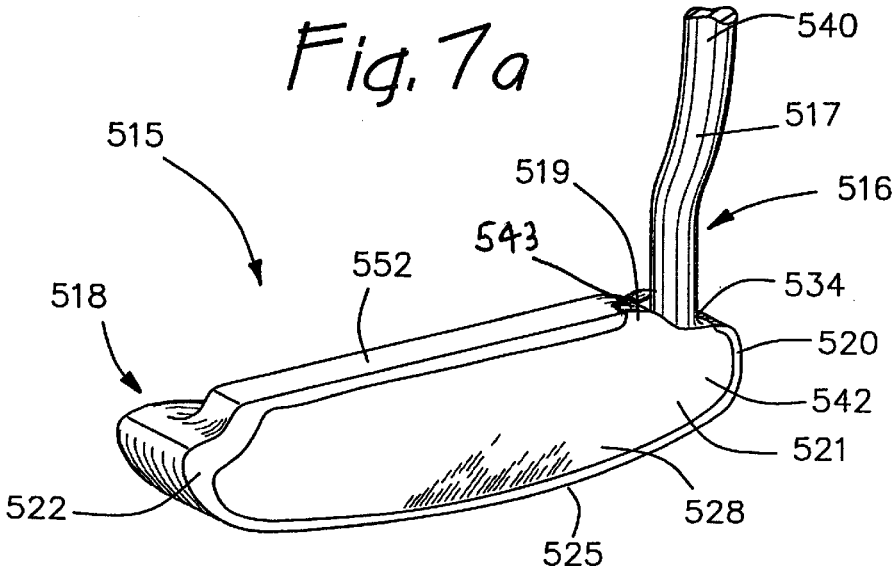
FIGS. 7*a*–7*c* are, respectively, a perspective view, a rear view and a sectional view of another golf club incorporating the invention.
Figure 7B:
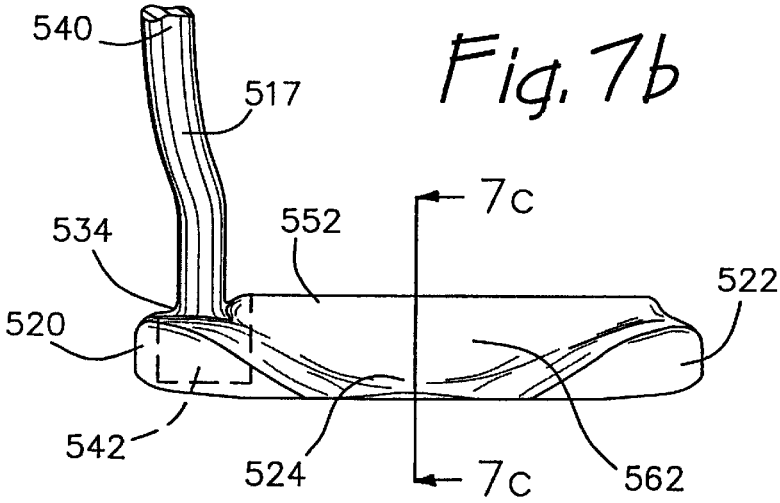
Figure 7C:
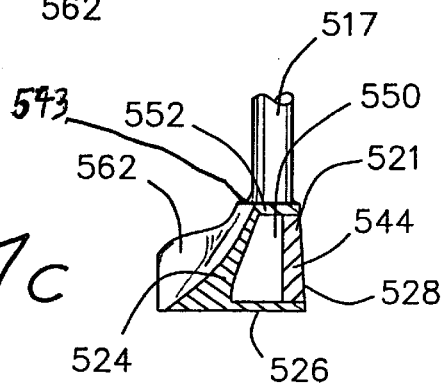

Referring to FIGS. 7*a*–7*c*, FIG. 7*a* is a perspective view of another embodiment 516 of the clubhead constructed in accordance with this invention. This embodiment includes an integral insert and hosel 516 comprising the insert 521 and the hosel 517 formed as a unit with a fairing 534. In the embodiments of FIGS. 7*a*–*c*, the insert 521 is a forward blade 544 which defines the insert striking surface 528 and is connected to an insert base 542 which also comprises the underlying base of the hosel 517. In this embodiment the striking surface 528 is flat but canted to provide a slight loft within the guidelines of the P.G.A. The shell 518 includes a heel portion 520, a toe portion 522, and a medial portion 524 which is integral with a sole wall 526 and a top wall 552. The insert 521 includes the striking face wall 544 integral with the base portion 542 having top surface 543 and the hosel 517. The shell 518 is formed to define a cavity 550 comprising longitudinal top wall 552, bottom wall 526 and medial wall 524, in cooperation with the heel and toe portions 520 and 522. The cavity 550 and insert 521 are configured to provide the desired sound as the striking surface 528 impacts with the golf ball. The embodiment of FIGS. 7*a*–*c* includes a back cavity 562 to provide the desired polar weight distribution and the optimum appearance from the golfer's perspective as he sights down the shaft and hosel.

Figure 8A:
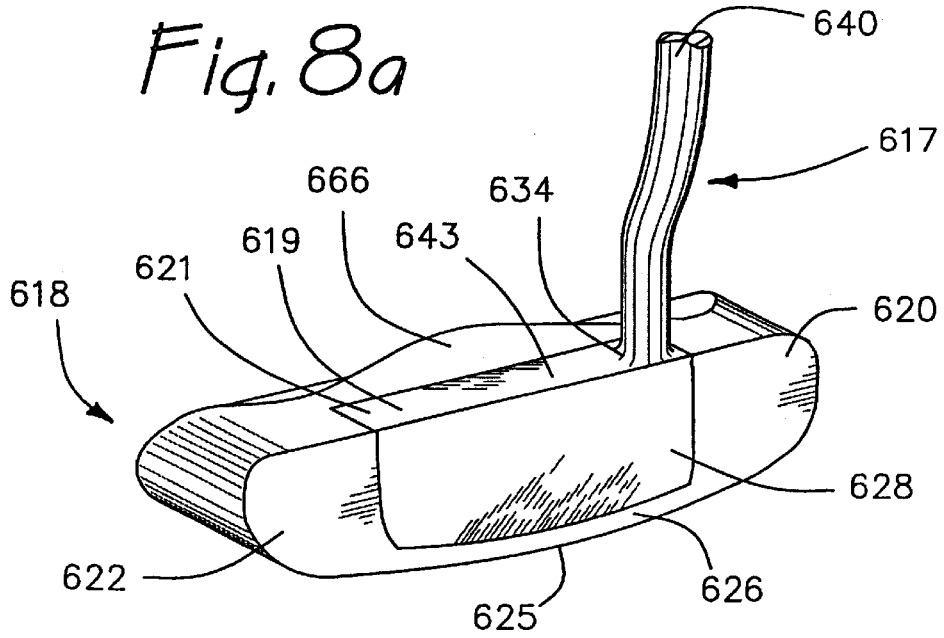
FIGS. 8*a*–8*c* are, respectively, a perspective view, a rear view and a sectional view of the clubhead portion of still another embodiment of the invention.
Figure 8B:
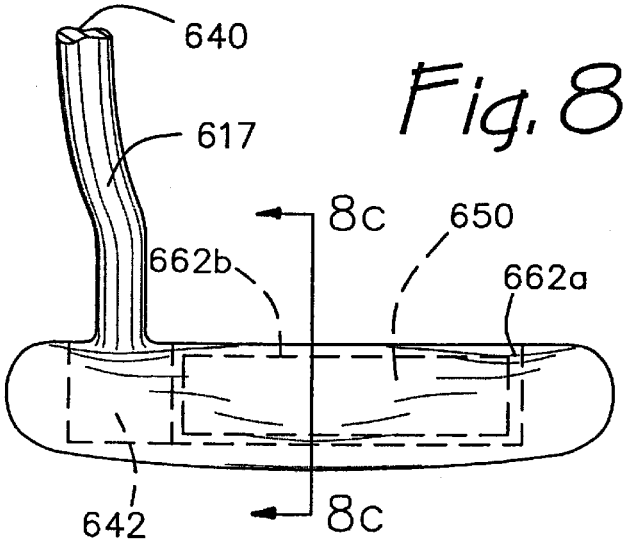
Figure 8C:
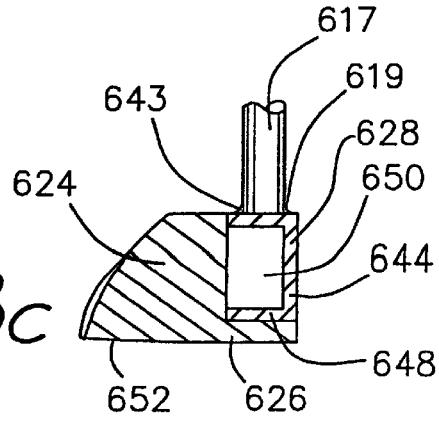

The embodiment of FIGS. 8*a*–8*c* has a configuration similar to the embodiment of FIGS. 6*a*–*c*. However, in this embodiment the hosel 617 is connected through the base portion 642 to a channel-shaped insert including the striking surface wall 644, a bottom wall 648, and an extended top wall 643. Cavity 650 is defined by those three insert walls and the medial portion 624 of the shell. In the embodiment of FIGS. 8*a*–*c*, the top wall 643 of the insert has a rectangular sighting surface 619 behind the striking surface 628. A chevron 666 is formed behind the insert 621 in the medial portion 624 of shell 618. The bottom wall 648 of the insert is disposed above the sole surface 625 which is defined and established by the shell sole wall 626. The embodiment of FIGS. 8*a*–*c* has a modified back cavity 662*a* and 662*b* on respective sides of shell chevron 666 which optimizes the balance and weight distribution of the club and emphasizes the sighting benefits of the chevron 666.

Yet another embodiment of the invention is shown in FIGS. 9*a*–9*e*. In this embodiment the combined insert and hosel 716 is illustrated incorporating a curved hosel 717 similar to that shown in FIGS. 1 and 2. The hosel 717 of the insert/hosel 716 is combined with a solid insert 721 having a sighting surface 719, a bottom sole 748, a striking face 744, and a back face 746. The top wall 743 is provided with a sighting lines or other indicia 782 for enhanced sighting and appearance of the clubhead. The sighting indicia 782 can be one line or a pattern formed in the surface of the insert as shown in FIGS. 9*a*–*e*. The indicia 782 can also be on the surface or raised above the top surface of the insert.

A back cavity 762 is defined by the medial shell portion 724 and back face 746 of insert 721. Back cavity 762 joins a rear shelf 756 of shell 718. The shelf configuration includes large heel portion 720 and toe portion 722 and the thin medial shelf portion 724 configured to add polar weight to the overall club balance with the toe shelf 770 and the heel shelf 772 providing enhanced polar balance and the desirable shelf appearance. The medial portion 724 of the shell cooperates with the toe portions 770 and heel portions 772 and with the insert 721 to define the sole surface 725 of the embodiment of FIGS. 9*a*–*e*.

Figure 9A:
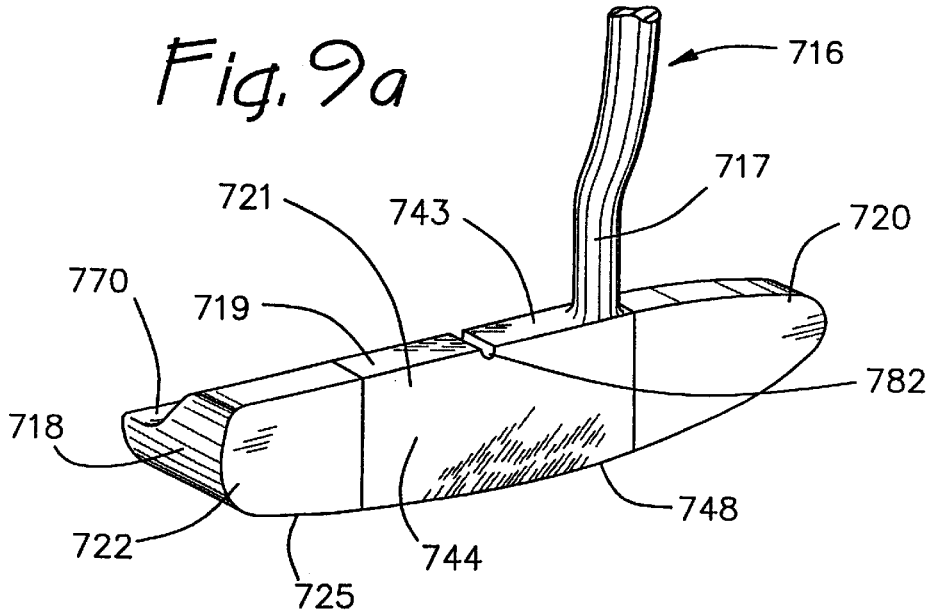
FIGS. 9*a*–9*e* are directed to a preferred embodiment of the invention and are, respectively, a perspective view, a rear view, a cross sectional view, a partially sectional and partially exploded view and a sectional view along the line 9*e*—9*e* of FIG. 9*d;*
Figure 9B:
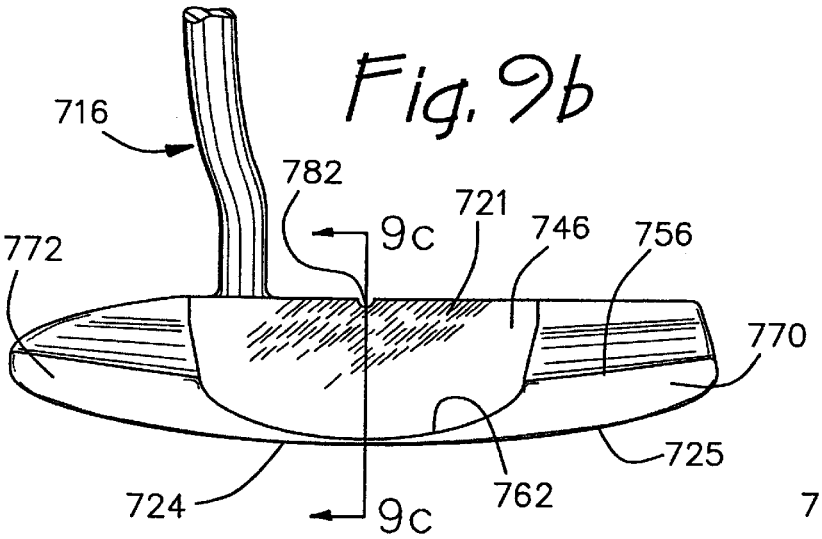
Figure 9C:
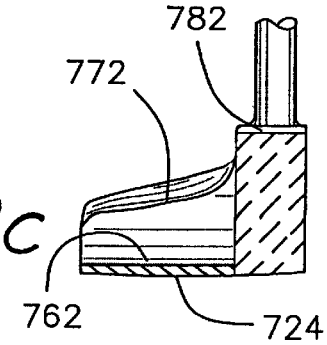
Figure 9E:
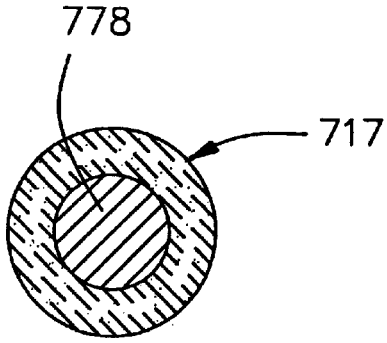
Figure 9D:
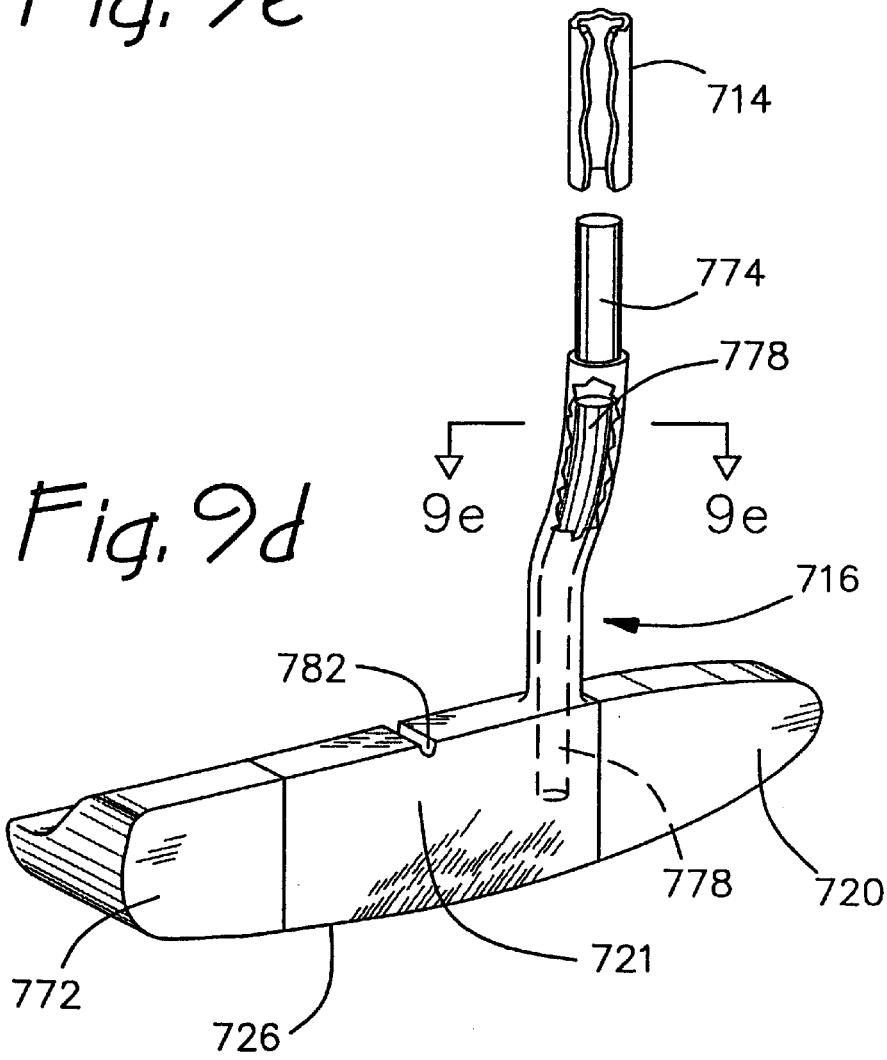

The specific configuration of the combined insert and hosel 716 in cooperation with the clubhead end of the shaft 714 is shown partially exploded and partially in section in FIG. 9*d*. Where the combined insert and hosel 716 and the shaft 714 are to be formed of the same material they can be formed as a single unit. The hosel in all of the embodiments described herein is preferably reinforced with a central armature 778 formed within the hosel 717. As illustrated in FIG. 9*d*, partially in section, and in FIG. 9*e*, in cross section, the armature 778 is configured to the shape of the hosel 717 and extends into the insert 721. The hosel and insert 716 is preferably formed of a lightweight material and, in particular, nonmetallic high strength materials such as graphite composites and fiberglass and resin composites. Using such materials and the illustrated configuration, the armature 778 is cast within the hosel 717 and extends into the insert 721 as well. The sighting line 782 formed in the top surface 743 of insert 719 may be employed in all embodiments.

In preferred embodiments of the invention, the hosel at its upper end has a reduced diameter extension 774 to receive the hollow clubhead end of the shaft 714 (shown partially broken away and exploded above the hosel 717 for clarity).

Figure 9F:
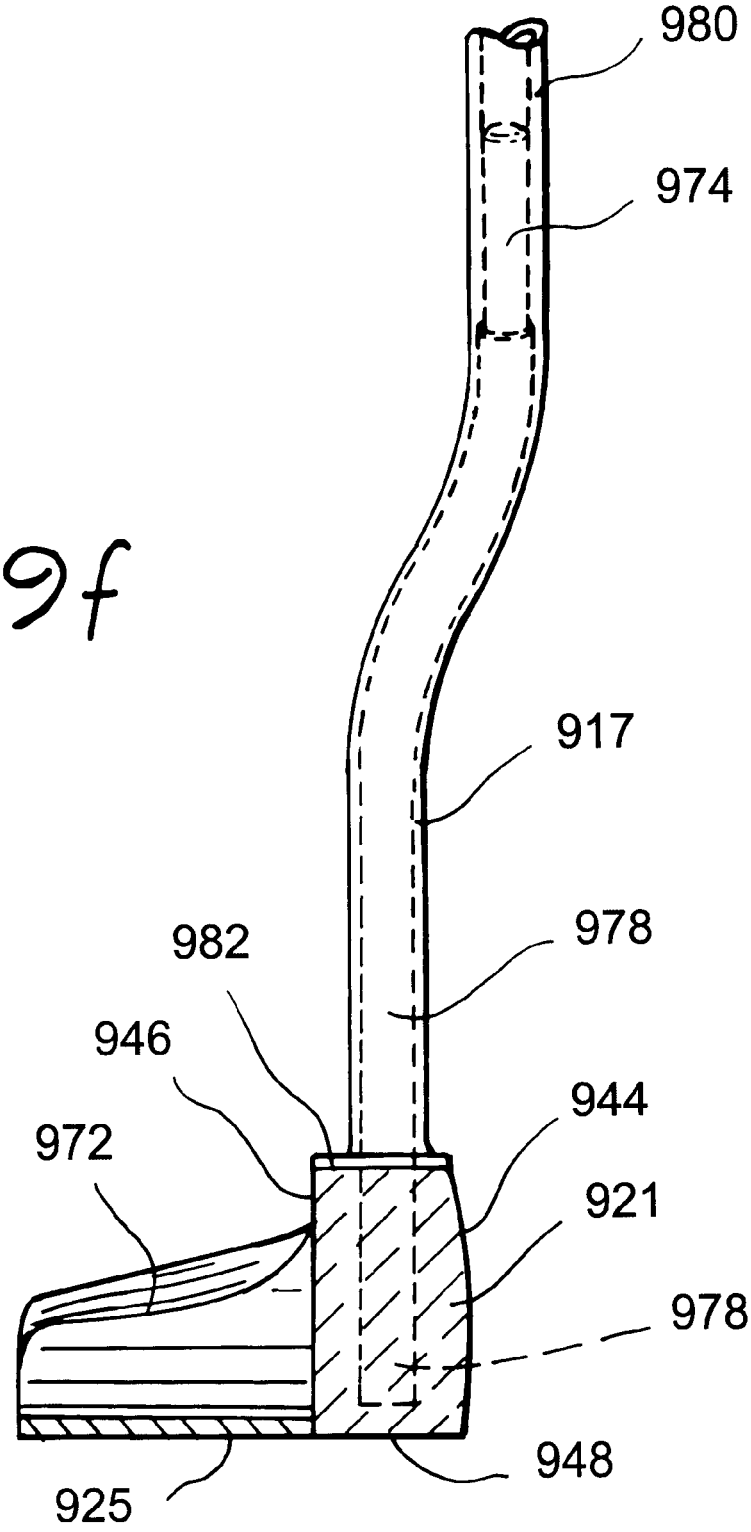
FIG. 9*f* is a partially sectional view of an alternate preferred embodiment of the invention taken at lines 9*c*–9*c* of FIG. 9*b* showing the insert, hosel and shaft formed as a single piece.
Figure 10A:
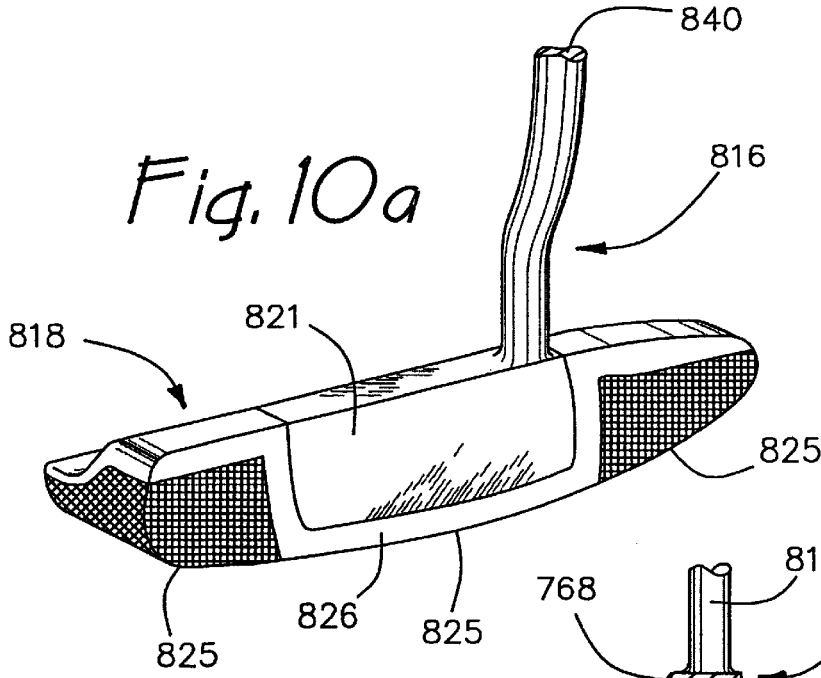
FIGS. 10*a*–10*d* are, respectively, a perspective view, a rearview and sectional views of an additional preferred embodiment of the clubhead portion of the invention including added mass elements in the toe and heel sections.
Figure 10C:
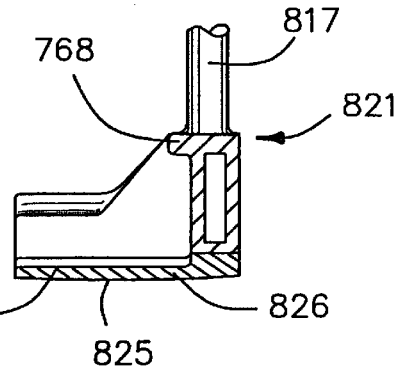
Figure 10B:
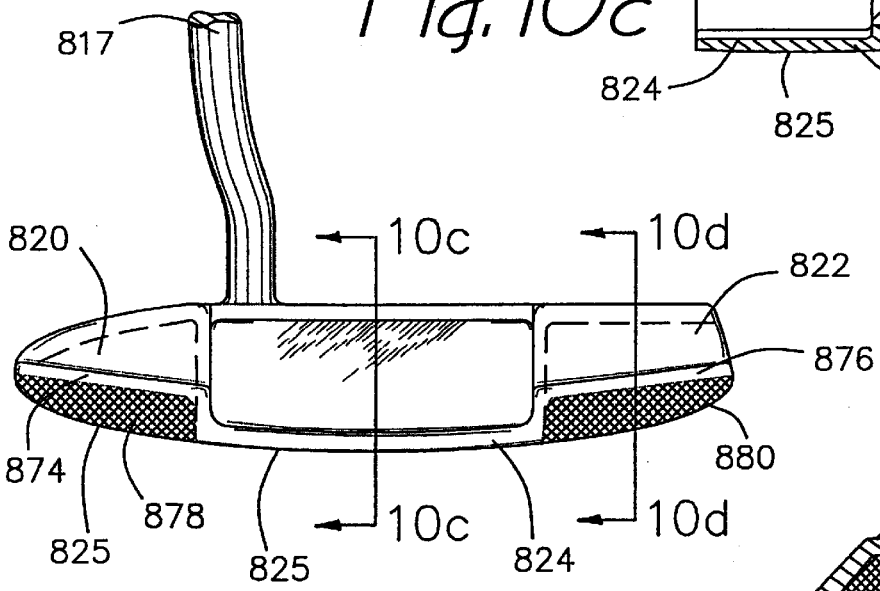
Figure 10D:
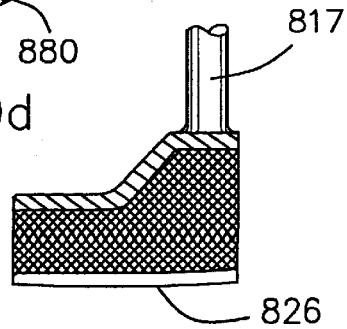

Another embodiment of the invention similar to that of FIGS. 9*a–e* is the golf club exemplified by FIG. 9*f*. The clubhead of FIGS. 9*a–c*, 9*e* and 9*f* is the same as that shown in FIGS. 9*a–e*. It has a polar toe shelf and a polar heel shelf 972 corresponding to toe shelf 770 and heel shelf 772 in FIG. 9*a*. The insert 921 and hosel 917 are formed of a non-metallic material such as a graphite resin around the armature 978. The non-metallic shaft 980 is also formed of the same non-metallic material such as a graphite resin. The reduced diameter extension 974 conforms to the hollow shaft 980. The crevice 982 formed in the top of the insert 921 provides a sighting aid and the bottom surface 948 comprises the sole of the club in cooperation with shell sole surface 925. The insert 921 defines a striking surface 944 and a back face 946.

Referring now to FIGS. 10*a*–10*d*, the preferred embodiment shown therein has a combined insert and hosel 816 in cooperation with the shell 818.

However, embodiments according to FIGS. 10*a–d* have a toe and heel configuration significantly different from that illustrated in the other embodiments. In the embodiment of FIGS. 10*a–d*, the shell 818 is configured to define open heel and toe ends. The shell 818 has a medial portion 826 secured to and underlying the insert 821 and a shelf portion 824 extending rearwardly to define a back shelf and cavity defining an extended sole surface 825. In the heel and toe regions, the shell 818 has a heel portion 820 including a cap portion 874, and the toe portion 822 similarly provides a cap portion 876. High mass density weights are configured to fit under the heel and toe caps 874, 876. The heel high mass density polar weight 878 is conformed to the heel cap 874 and defines a part of the sole 825. Similarly, the toe high mass density polar weight 880 is shaped to conform to the toe cap 876, is secured thereto and provides the toe portion of sole 825. In a typical implementation of these embodiments, the shell may be fabricated from lightweight metal materials such as aluminum or brass or may even be fabricated from composite materials. The polar weights 878 and 880 form a part of the shell and are preferably of higher mass density such as tungsten or steel to provide the polar weight distribution in the shell that enhances the force dynamics during the putting motion.

While various embodiments of the invention have been described incorporating various elements of the invention in different optimum combinations, the overall objectives of the invention and the specific enhancements described with respect to certain embodiments are all parts of the invention. It is contemplated that the invention may be implemented in such various combination all of which are intended to be encompassed within the scope of the following claims.

What is claimed is:

1. A golf club comprising:

a shaft having a player gripping end and a clubhead end; and a clubhead connected to said shaft at said clubhead end, said clubhead having a heel, a toe, a sole and a top and a striking face between said sole and said top said clubhead including:

a combined elongate insert and hosel, said insert having a toe end, a heel end, an upper surface comprising a portion of said clubhead top, extending longitudinally between said ends and a striking surface forming a portion of said striking face extending downwardly from said upper surface, said hosel extending upwardly from said upper surface and extending from the clubhead end of said shaft; and a shell secured to said insert defining a longitudinal cavity behind the striking surface and within a space defined by said insert and said shell, said shell including a distal toe portion extending outwardly from the toe end of said insert, a heel portion extending outwardly from the heel end of said insert, and a medial portion extending between said toe portion and said heel portion, the material and shape of said heel portion and said toe portion being selected to provide mass concentration at the heel end and the toe end of said clubhead.

2. The golf club of claim 1 wherein said shell includes a sole portion longitudinally extending between said toe portion and said heel portion, underlying said insert and secured thereto.

3. The golf club of claim 2 wherein said medial portion extends rearwardly from said insert to define a chevron-like sighting aid.

4. The golf club of claim 1 wherein said insert defines a tubular cavity having a base at said heel end and longitudinal surfaces extending therefrom defining said upper surface and said striking surface coupled to a bottom surface below said upper surface and a back surface behind said striking surface.

5. The golf club of claim 4 wherein said medial portion is coupled to and extends below said bottom surface to define a clubhead sole surface having a rearward extension behind said bottom surface.

6. The golf club of claim 3 wherein said rearward extension extends rearwardly from said toe portion, said heel portion and said medial portion.

7. The golf club of claim 6 wherein said rearward extension defines a generally horizontal shelf surface spaced from said sole surface and below said insert.

8. The golf club of claim 4 wherein the upper surface of said insert extends rearwardly beyond said cavity to provide a chevron-like sighting aid.

9. The golf club of claim 4 wherein a part of said toe portion and a part of said heel portion are of a material having a specific gravity greater than that of said shell.

10. The golf club of claim 1 wherein said medial portion includes an upper segment partially overlying and sealed to a distal portion of said insert and extending to said striking face.

11. The golf club of claim 10 wherein said insert comprises a generally flat blade integral with said hosel, extending longitudinally therefrom and sealed to said shell to define said cavity.

12. The golf club of claim 1 wherein said insert extends to and is a part of said sole and said top.

13. A golf club comprising:

a shaft having a player gripping end and a clubhead end; and a clubhead connected to said shaft at said clubhead end, said clubhead having a heel, a toe, a sole and a top and a striking face between said sole and said top, said clubhead including:

a combined elongate insert and hosel, said insert having a toe end, a heel end, an upper surface comprising a portion of said clubhead top extending longitudinally between said ends and a striking surface forming a portion of said striking face extending downwardly from said upper surface whereby said upper surface is aligned with said striking surface, visible to a player gripping said player gripping end of said shaft and oriented to the shaft as a sighting aid, said hosel extending upwardly from said upper surface and extending from the clubhead end of said shaft; and a shell secured to said insert defining a longitudinal cavity behind the striking surface and within a space defined by said insert and said shell, said shell including a distal toe portion extending outwardly from the toe end of said insert, a heel portion extending outwardly from the heel end of said insert, and a medial portion extending between said toe portion and said heel portion, the material and shape of said heel portion and said toe portion being selected to provide mass concentration at the heel end and the toe end of said clubhead.

14. A golf club comprising:

a shaft having a player gripping end and a clubhead end; and a clubhead connected to said shaft at said clubhead end, said clubhead having a heel, a toe, a sole and a top and a striking face there between, said clubhead including:

a combined elongate insert and hosel formed of a non-metallic material and an armature, said insert having a toe end, a heel end, an upper surface comprising a portion of said clubhead top extending longitudinally between said ends and a striking surface forming a portion of said striking face extending downwardly from said upper surface, said hosel extending upwardly from said upper surface above said striking surface and extending from the clubhead end of the shaft, said insert and said hosel being formed around said armature, and said armature interconnecting said insert and said hosel; and a shell secured to said insert, said shell including a distal toe portion extending outwardly from the toe end of said insert and a heel portion extending outwardly from the heel end of said insert and a medial portion extending between said toe portion and said heel portion, the material and shape of said heel, toe and medial portions being selected to provide mass concentration at the heel end and the toe end of said clubhead.

15. The golf club of claim 14 wherein said combined insert and hosel is formed as a single piece surrounding said armature.

16. The golf club of claim 15 wherein said combined insert and hosel is formed of a generally homogeneous non-metallic material.

17. The golf club of claim 14 wherein the combined insert and hosel is formed of a graphite composite.

18. The golf club of claim 14 wherein said combined insert and hosel is formed of a generally homogeneous composite including glass fibers and a resin.

19. The golf club of claim 14 wherein said toe portion, medial portion and heel portion are secured to said insert and form seals therewith.

20. The golf club of claim 14 wherein said striking face is a segment of a longitudinal cylindrical surface having a curved cross section.

21. The golf club of claim 14 wherein said shaft and said combined insert and hosel are formed of the same material as a single piece.

22. The golf club of claim 14 wherein said shaft and said combined insert and hosel are formed of a graphite material as a single piece.

* * * * *

UNITED STATES PATENT AND TRADEMARK OFFICE

CERTIFICATE OF CORRECTION

PATENT NO. : 7,037,211 B1
APPLICATION NO. : 09/618076
DATED : May 2, 2006
INVENTOR(S) : Milana Kosovac It is certified that error appears in the above-identified patent and that said Letters Patent is hereby corrected as shown below:

Claim 6, col. 8, line 43, delete “claim 3” and insert --claim 5--.

Signed and Sealed this

Twenty-seventh Day of February, 2007

JON W. DUDAS
*Director of the United States Patent and Trademark Office*